US006783032B2

(12) United States Patent
Fons

(10) Patent No.: US 6,783,032 B2
(45) Date of Patent: Aug. 31, 2004

(54) STEEL CONTAINER, ESPECIALLY INTENDED FOR THE TRANSPORT OF BULK GOODS

(75) Inventor: Bas Fons, Koog Aan de Zaan (NL)

(73) Assignee: Jansens & Dieperink B.V., Zaandam (NL)

( * ) Notice: Subject to any disclaimer, the term of this patent is extended or adjusted under 35 U.S.C. 154(b) by 0 days.

(21) Appl. No.: 10/149,183

(22) PCT Filed: Dec. 8, 2000

(86) PCT No.: PCT/NL00/00909

§ 371 (c)(1),
(2), (4) Date: Oct. 2, 2002

(87) PCT Pub. No.: WO01/42110

PCT Pub. Date: Jun. 14, 2001

(65) Prior Publication Data

US 2003/0089742 A1 May 15, 2003

(30) Foreign Application Priority Data

Dec. 8, 1999 (NL) ..... 1013796

(51) Int. Cl.[7] ..... B67D 1/08

(52) U.S. Cl. ..... 222/148; 222/183; 222/185.1; 222/462

(58) Field of Search ..... 222/148, 183, 222/185.1, 462

(56) References Cited

U.S. PATENT DOCUMENTS

| | | | | |
|---|---|---|---|---|
| 2,686,613 A | * | 8/1954 | Tamminga | 222/80 |
| 3,111,242 A | * | 11/1963 | Reed | 222/183 |
| 3,325,058 A | * | 6/1967 | West, Jr. | 222/146.5 |
| 4,119,110 A | * | 10/1978 | Stone | 137/15.04 |
| 5,356,029 A | * | 10/1994 | Hogan | 229/117.3 |
| 5,613,622 A | * | 3/1997 | Surrena et al. | 222/105 |
| 5,782,381 A | * | 7/1998 | Woodruff et al. | 222/23 |

FOREIGN PATENT DOCUMENTS

| | | |
|---|---|---|
| DE | 1 278 932 | 9/1968 |
| GB | 1 276 795 | 6/1972 |

* cited by examiner

*Primary Examiner*—Joseph A. Kaufman
(74) *Attorney, Agent, or Firm*—Young & Thompson

(57) ABSTRACT

Inside a steel container (1, 17, 23), a bin (3) of corrosion-resistant material is fitted. This bin (3) is fastened to the container walls. The side walls and the top wall of the bin are substantially identical in shape to those of the steel container. The container is intended for the transport of bulk goods, especially plastics particle material, the contamination of this material by steel particles, which have come loose as a result of corrosion, being prevented.

17 Claims, 4 Drawing Sheets

Fig 1
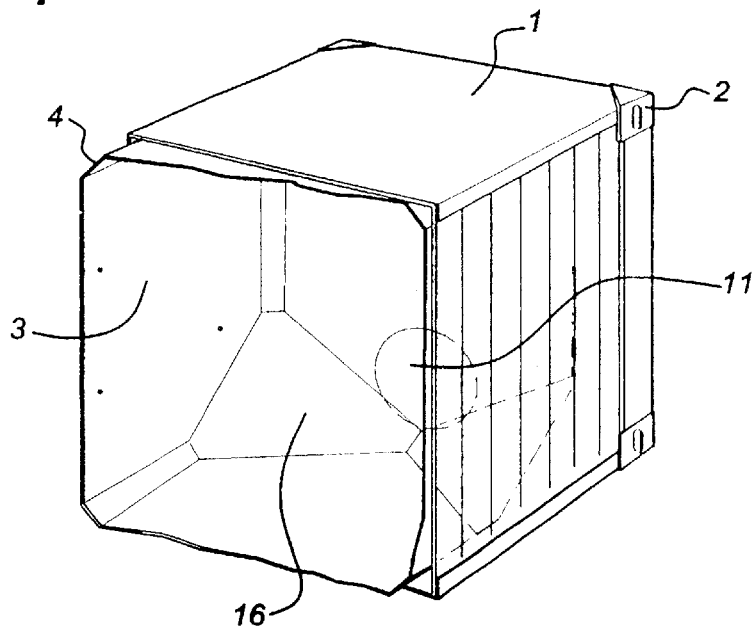
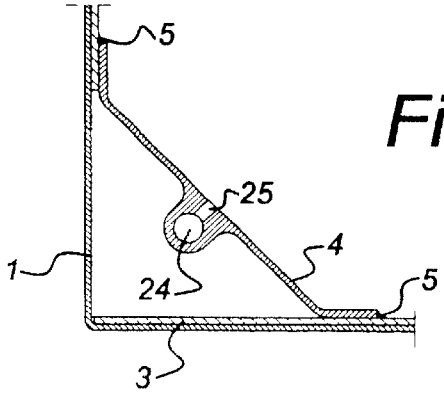
Fig 2
Fig 3
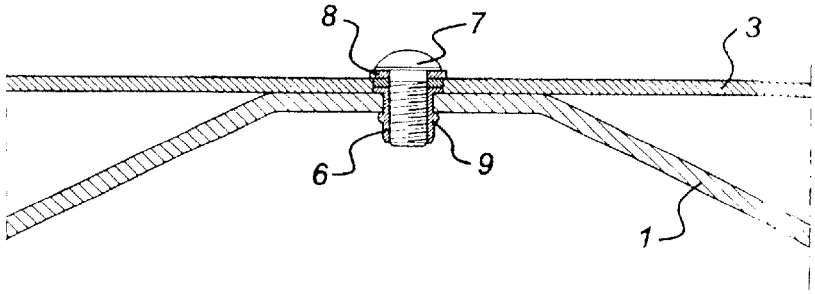

STEEL CONTAINER, ESPECIALLY INTENDED FOR THE TRANSPORT OF BULK GOODS

BACKGROUND OF THE INVENTION

The invention relates to a steel container, especially intended for the storage and transport of bulk goods, the inner surfaces of the container being covered by walls made of corrosion-resistant material, which walls together form a closed box, the upright side walls and the top wall of which are substantially identical in shape to those of the steel container.

DESCRIPTION OF THE RELATED ART

Such a container is disclosed in GB-A-1276795.

Transport of plastics particle material in steel ISO containers or steel high-cube containers produces problems if the plastics particles come into direct contact with the steel inner surfaces of the container walls. Steel particles which come loose as a result of corrosion of these walls are extremely damaging to the extruder in which the plastics particle material is processed, whilst, moreover, the product emerging from the extruder will be of relatively low quality. The customary solution to this problem is to hang up a large plastics sack (inner liner) in the container and to feed the plastics particles into this. This solution exhibits a number of drawbacks. The fitting of a sack in a container, the filling of the sack and the emptying thereof is time-consuming. Moreover the sacks are difficult to empty fully, so that material is left behind. In order to keep the sacks in place as the container is tipped, a frame (bulkhead) is erected, which can consist of wood and/or cardboard and/or steel tubular profiles. These materials have to be removed, which can cause a problem. Sometimes the sacks tear, so that steel particles emanating from the container manage, after all, to find their way into the plastics material. The sacks are used once and thrown away, including the plastics granules remaining therein, which is bad for the environment and entails costs.

The above-mentioned GB-A-1276795 deals with the difficulties encountered in forming the connection at the angular joint between two meeting walls especially at a corner where three walls meet. This problem is due to the fact that the walls seldom abut at exactly right angles. This document does not give a solution for the above-mentioned problems.

SUMMARY OF THE INVENTION

The object of the invention is to avoid the abovementioned problems with the transport of plastics particle material or other bulk material in containers, without experiencing the abovementioned drawbacks.

According to the invention, the steel container specified in the introduction is, to this end, characterized in that one or more fill openings are make either in a bulk head of the closed box or in the upper wall of the closed box, which fill openings may be closed off by a lid and can be brought in communication with the space outside the steel container via an open door or via an opening in the upper wall of the container, that one or more discharge openings are made either in a bulkhead of the closed box or in the lower wall of the closed box, which discharge openings can be closed off by a lid, and that the discharge openings are flanged by funnel-shaped bottom walls extending towards the discharge openings.

As the corrosion-resistant material, stainless steel and hard plastic (including composite) enter into consideration, though an aluminium alloy, for example an aluminium magnesium alloy, is preferable owing to the low price and low weight and the excellent anti-corrosive properties.

The transportation of solid plastics in the containers according to the invention, for example from the plastic producer to the processing plant, yields a positive environmental effect. The plastic remains pure. There is no loss of plastic. Both the steel walls of the container and the corrosion-resistant bin inside the container are recyclable.

In order to connect together the steel container walls and the walls of corrosion-resistant material, the fastening between the steel container walls and the walls of corrosion-resistant material can be formed by a bushing inserted through a mutually aligned opening in both walls and in which the screw bolt is turned, which bushing is deformed into an annular thickening lying against the outer side of the steel wall. Such a connection is denoted by the term blind rivet nut. At least the transitions from the long side walls into the top wall and from a short side wall into the top wall and the long side walls preferably comprise angled or rounded parts, which are welded at their bent-over flat ends to the vertical and horizontal walls of closed box The internal bin of corrosion-resistant material must regularly be cleaned. This can easily be realized if a water pipe having spray openings emerging in the closed box of corrosion-resistant material is moulded onto those angled or rounded corner pieces of the box of corrosion-resistant material which run in the longitudinal direction of the container.

The invention further relates to a method for storing and transporting bulk material, especially plastics particle material, in containers, in which the bulk material is situated unpacked in the internal bin of a container according to one of the claims.

BRIEF DESCRIPTION OF THE DRAWINGS

The invention will be now explained in greater detail with reference to the figures, in which:

FIG. 1 shows a perspective view of a portion of an ISO container constructed according to the invention, FIG. 2 shows a cross section through a corner of the container according to FIG. 1, FIG. 3 shows a cross section through a wall of the container.

DESCRIPTION OF THE PREFERRED EMBODIMENTS

Figure 4:
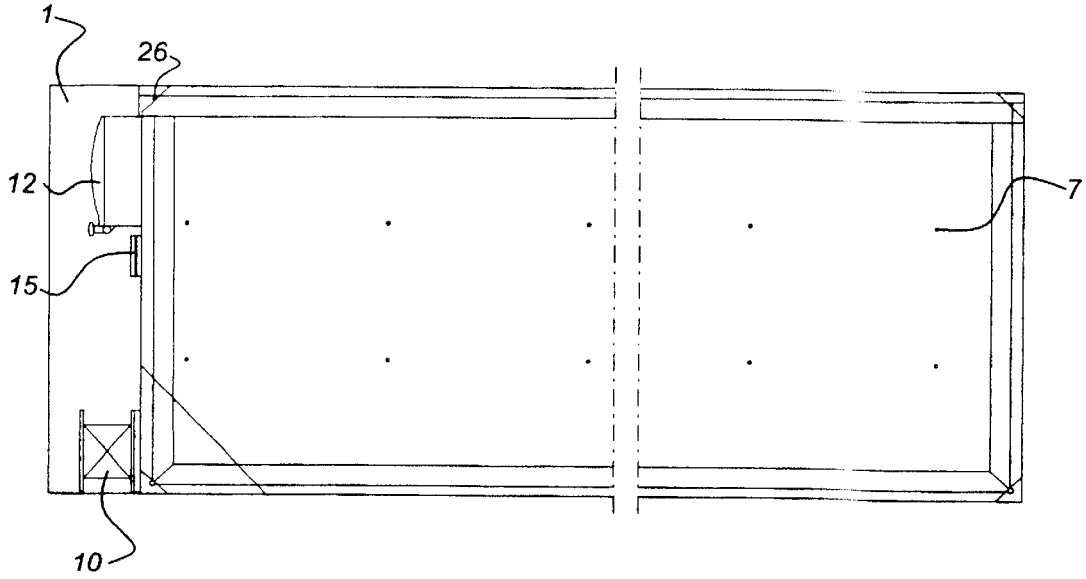
FIG. 4 shows a longitudinal section of the container according to FIGS. 1–3.
Figure 5:
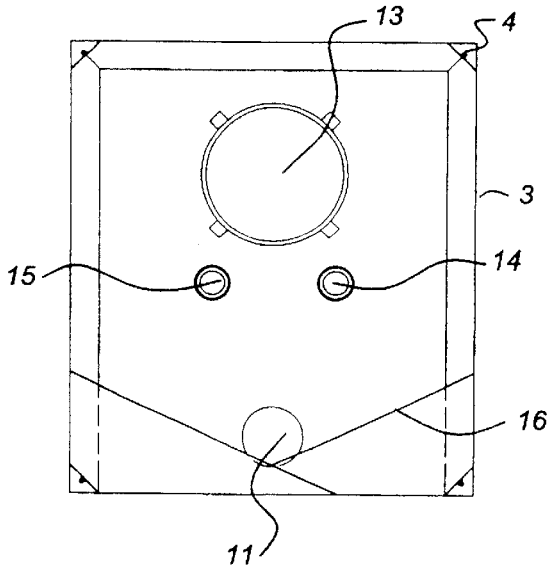
FIG. 5 shows a front view of the internal bin of the container according to FIGS. 1–4.

In FIG. 1, a part of a steel ISO container 1 can be seen. Such containers are used in large numbers in the 20', 40', 30' and 45' sizes and possess at the comers usual facilities 2 to enable them to be locked to a hoisting trestle or to one another with the aid of twist locks. Inside the ISO container 1, a bin 3 of corrosion-resistant material is fastened, the shape of which substantially conforms to the parallelepipedal shape of the ISO container. Unlike the ISO container, the bin 3 has angled or rounded transition parts 4 at the transitions from an upright long side into the floor and into the top wall; as well as at the transitions from the bin wall, situated close to the thick short side of the container, into the floor and top wall of the bin. These transition parts 4—as shown by FIG. 2—are fastened at bent-over end edges to the walls of the bin 3 by means of a weld joint 5 extending over the length of the wall concerned.

The flat walls of the bin 3 of corrosion-resistant material are fastened to the steel ISO container walls by means of connections, one of which is shown in cross section in FIG. 3. A bushing 6 made from deformable material is inserted through aligned openings in the steel wall of the container and the wall of the corrosion-resistant bin 3 and a screw bolt 7 is screwed through this bushing 6. This bolt 7 presses with its head, via a sealing ring 8, onto the corrosion-resistant material. On the opposite side, the screwed-in bolt has deformed the bushing material in such a way that the thickening 9, which engages the steel wall of the container 1, has been formed. Such a connection is referred to as a blind rivet nut.

The narrow upright wall of the bin 3—the bulkhead, as it is known—which is situated close to the doors of the steel ISO container, is provided with a discharge opening 11 close to the floor of the bin 3, which discharge opening can be closed off by a butterfly valve 10, a manhole 13 close to the top wall of the bin 3, which manhole can be closed off by a hinged door 12, and two inspection holes 14, 15 somewhat below the manhole 13. The bin is filled via the manhole 13, a conveyor belt being able to be introduced temporarily through that manhole in order to bring bulk material, especially plastics particles, into the bin in well-distributed arrangement. The discharging of the bin is realized by tilting the container 1 with bin 3 and opening the butterfly valve 10. At the sites of the opening 11, angled partitions 16 are fitted, which prevent the material to be discharged from being left in the corners of the bin 3.

The bin 3 preferably consists of an aluminium alloy, such as an aluminium magnesium alloy. This material is lightweight, is corrosion-resistant by virtue of the presence of an oxide film on the surfaces and is not unduly expensive. Stainless steel and a hard plastic, including a composite material, are not, however, precluded.

Figure 6:
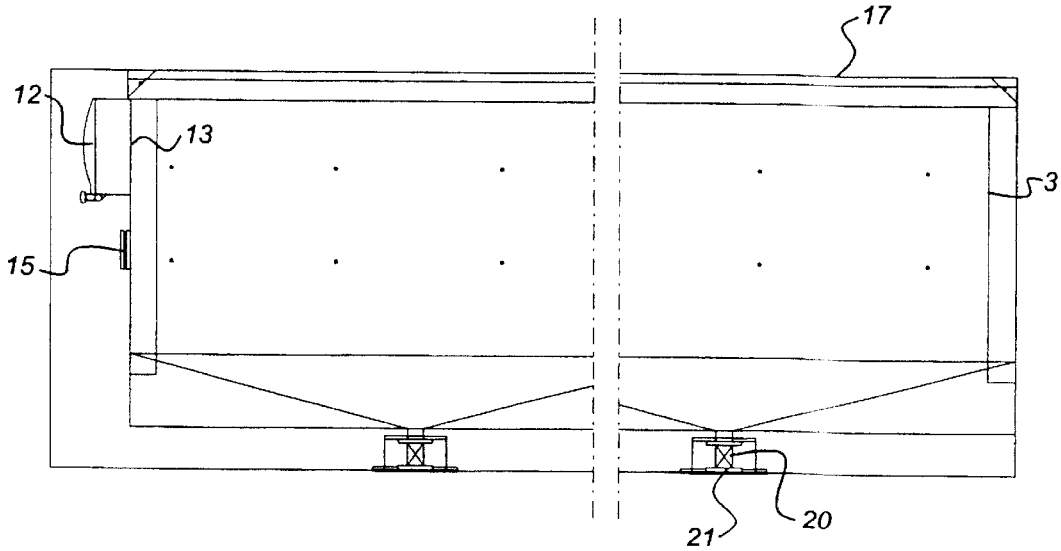
FIG. 6 shows a longitudinal section of a high-cube container according to the invention having a floor consisting of funnel-shaped discharge elements.
Figure 7:
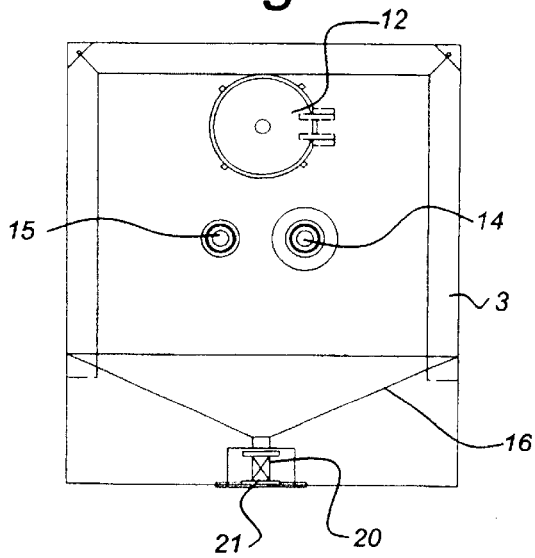
FIG. 7 shows a front view of the internal bin of the high-cube container according to FIG. 6.

The embodiment according to FIGS. 6 and 7 does not relate to an ISO container, but to a high-cube container 17, in which an internal bin 3 is fitted. This high-cube container with internal bin has a number of discharge openings 21, which can be closed off by a valve 20 and which are situated at the bottom end of funnel-shaped floor parts 22. The internal bin 3 is filled in the same way as the internal bin of the ISO container discussed above, that is to say via a manhole 13, which can be closed off by a door 12, and a conveyor belt, which can be introduced via that manhole. There are also inspection holes 14, 15, which are closed off by glass.

It will be clear that this container does not need to be tilted during discharging, since the material leaves the container via the discharge openings 21. The discharge openings 21 above the floor of the carbon steel container 17 are not precluded from emerging in a horizontal pipe, which is connected to a vacuum appliance for discharging of the bulk material.

Figure 8:
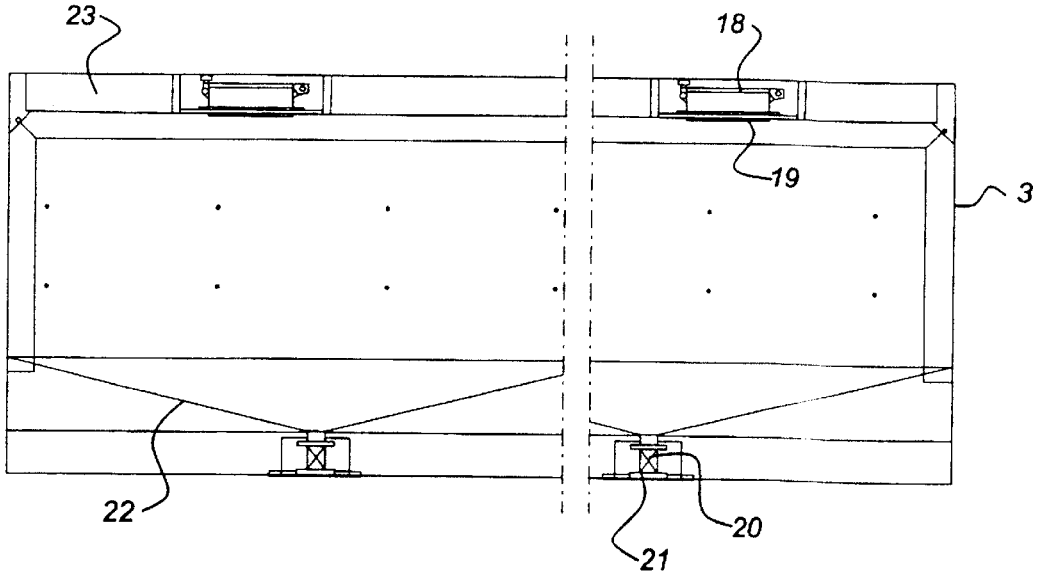
FIG. 8 shows a longitudinal section of an alternative embodiment of a high-cube container according to the invention which differs from that according to FIGS. 6 and 7 by the placement of fill openings in the top wall.
Figure 9:
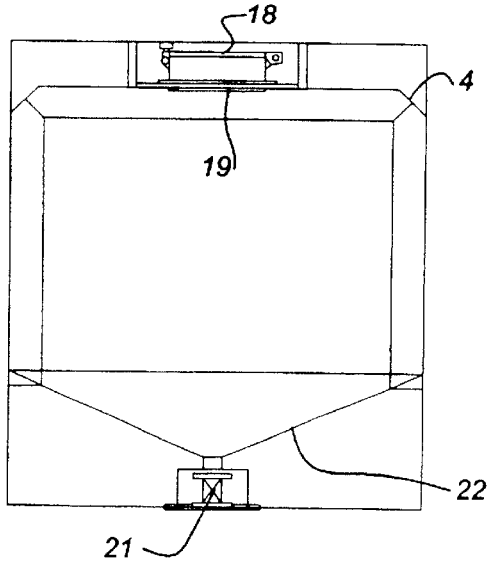
FIG. 9 shows a front view of the internal bin of the container according to FIG. 8.

The embodiment according to FIGS. 8 and 9 likewise relates to a high-cube container 17, in which an internal bin 3 made of corrosion-resistant material is fitted. This container has on the top side a number of fill openings 19, which can be closed off by a lid 18 and into which plastics material can be fed. As in the container according to FIGS. 6 and 7, discharge openings 21, which can be closed off by a valve 20, are made. These are situated at the bottom end of funnel-shaped floor parts 22.

It is important that the inside of the bin 3 of corrosion-resistant material of the abovementioned containers can easily be cleaned on the inside. To this end, water pipes 24 are moulded onto the angled corner parts 4 of the internal bin 3 of the containers 1, 17 and 23, which water pipes are provided at irregular intervals with spray openings 25, which emerge in the inside of the bin 3. The water pipes 24 are connected by snap couplings 26 (FIG. 4) to a water feed hose (not represented). Various modifications and additions are possible within the scope of the claims.

What is claimed is:

1. Steel container, for the storage and transport of bulk goods, the inner surfaces of the container being covered by walls made of an aluminum alloy, which walls together form a closed box, upright side walls and a top wall of which closed box are substantially identical in shape to walls of the steel container, one or more fill openings being made either in a bulkhead of the closed box or in an upper wall of the closed box, which fill openings are closable by a first lid and can be brought in communication with the space outside the steel container via an open door or via an opening in an upper wall of the steel container, wherein, one or more discharge openings are present either in a bulkhead of the closed box or in a lower wall of the closed box, which discharge openings are closable by a second lid, at least transitions from long side walls into the top wall and from a short side wall into the top wall and the long side walls comprise angled or rounded parts, and the discharge openings are flanged by funnel-shaped bottom walls extending towards the discharge openings.

2. Container according to claim 1, wherein a fastening between the steel container walls and the walls of closed box is formed by a bushing inserted through a mutually aligned opening in both walls and in which bushing a screw bolt is turned, which bushing is deformed into an annular thickening lying against an outer side of the steel container wall.

3. Container according to claim 1, wherein said transitions from the long side walls into the top wall and from the short side wall into the top wall and the long side walls are welded at bent-over flat ends to vertical and horizontal walls of the closed box.

4. Container according to claim 3, further comprising a water pipe having spray openings emerging in the closed box and moulded onto the angled or rounded corner pieces of the closed box which angled or rounded pieces run in a longitudinal direction of the container.

5. A steel container assembly for transporting bulk material, comprising:

an outer steel container with steel container walls and with an exterior opening;

a closed box located interior to and in contact with the outer steel container, the closed box comprising walls made of a corrosion-resistant material, the walls including side walls and a top wall, the wall being substantially identical in shape to the steel container walls, at least one fill opening in one of the walls of the closed box that, via the exterior opening, brings an interior space of the closed box into communication with an exterior space outside the steel container, a lid that closes the fill opening, at least one closable discharge opening in one of the walls of the closed box, and funnel-shaped bottom walls extending towards the discharge opening;

a bushing inserted through an aligned opening through one steel container wall contacting one closed box wall; and a screw bolt turned in the bushing, the bushing having an annular thickening lying against an exterior side of the one steel container wall.

6. The steel container assembly of claim 5, wherein, the closed box includes long side walls and a short side wall, and transitions from the long side walls into the top wall and transitions from the short side wall into the top wall and the long side walls comprise angled or rounded parts welded at bent-over flat ends.

7. The steel container assembly of claim 6, further comprising:

a water pipe having spray openings penetrating through the angler or rounder part and emerging into the interior space of the closed box.

8. The steel container assembly of claim 5, wherein the corrosion-resistant material is an aluminium alloy.

9. The steel container assembly of claim 5, wherein the corrosion-resistant material is a hard plastic.

10. The steel container assembly of claim 5, wherein the corrosion-resistant material is a stainless steel.

11. A steel container assembly for transporting bulk material, comprising:

an outer steel container with steel walls and with an exterior opening; and a closed box located interior to and in contact with the outer steel container, the closed box comprising walls made of a corrosion-resistant material, the walls including side walls and a top wall, the wall being substantially identical in shape to the steel container walls, the side walls including long side walls and a short side wall, at least one fill opening in one of the walls of the closed box that, via the exterior opening, brings an interior space of the closed box into communication with an exterior space outside the steel container, a lid that closes the fill opening, at least one closable discharge opening in one of the walls of the closed box, and funnel-shaped bottom walls extending towards the discharge opening; and transitions from the long side walls into the top wall and transitions from the short side wall into the top wall and the long side walls, the transitions comprising angled or rounded parts.

12. The steel container assembly of claim 11, wherein the angled or rounded parts of the transitions are welded at bent-over flat ends to the walls of the closed box.

13. The steel container assembly of claim 11, further comprising:

a bushing inserted through an aligned opening through one steel container wall contacting one closed box wall; and a screw bolt turned in the bushing, the bushing having an annular thickening lying against an exterior side of the one steel container wall.

14. The steel container assembly of claim 11, further comprising:

a water pipe having spray openings penetrating through the angler or rounder part and emerging into the interior space of the closed box.

15. The steel container assembly of claim 11, wherein the corrosion-resistant material is an aluminium alloy.

16. The steel container assembly of claim 11, wherein the corrosion-resistant material is a hard plastic.

17. The steel container assembly of claim 11, wherein the corrosion-resistant material is a stainless steel.

* * * * *